United States Patent [19]

Ushida et al.

[11] Patent Number: 4,620,513

[45] Date of Patent: Nov. 4, 1986

[54] ROTATIONAL POSITION DETECTING DEVICE FOR INTERNAL COMBUSTION ENGINE

[75] Inventors: Masayasu Ushida, Kariya; Yukio Nakamura; Kei Abe, both of Toyota, all of Japan

[73] Assignee: Nippondenso Co., Ltd., Kariya, Japan

[21] Appl. No.: 810,227

[22] Filed: Dec. 17, 1985

[30] Foreign Application Priority Data

Dec. 18, 1984 [JP] Japan ..... 59-268062

[51] Int. Cl.[4] ..... F02D 1/00; F02P 5/00

[52] U.S. Cl. ..... 123/146.5 A; 200/19 R

[58] Field of Search ..... 123/146.5 A, 612, 617; 200/19 R, 31 DP, 31 CA, 31 V, 22, 19 DC

[56] References Cited

U.S. PATENT DOCUMENTS

| | | | |
|---|---|---|---|
| 4,033,315 | 7/1977 | Kroger et al. | 123/146.5 A |
| 4,153,030 | 5/1979 | Pomer et al. | 123/146.5 A |
| 4,343,269 | 8/1982 | Fox et al. | 123/146.5 A |
| 4,359,978 | 11/1982 | Brammer et al. | 123/146.5 A |
| 4,434,754 | 3/1984 | Fox et al. | 123/146.5 A |
| 4,445,493 | 5/1984 | Coletti | 123/146.5 A |
| 4,449,888 | 2/1985 | Hino et al. | 123/146.5 A |
| 4,454,856 | 6/1984 | Fox et al. | 123/146.5 A |
| 4,538,564 | 9/1985 | Ehrmann et al. | 123/146.5 A |
| 4,550,697 | 11/1985 | Campen | 123/149 R |

*Primary Examiner*—Raymond A. Nelli

*Attorney, Agent, or Firm*—Cushman, Darby & Cushman

[57] ABSTRACT

An engine rotational position detector and distributor assembly has a crank-driven rotary member mounted on an end portion of a cam shaft extending outwardly from engine block. The end face of the rotary member is formed therein with an annular recess and has a reference position information projection on the radially inner peripheral wall of the recess and a plurality of angular position information projections on the radially outer peripheral wall of the recess. The rotary member is covered with a detector housing mounted on the engine block and having an outer end wall supporting sensors faced to the circular paths of circumferential movements of the projections on the rotary member. The detector housing end wall has central opening with a bearing mounted therein to receive the outer end portion of the cam shaft and position the detector housing relative to the cam shaft whereby the sensors are precisely positioned relative to the circular paths of the movements of the projections. The cam shaft terminates in an outer end extremity on which a distributor rotor is mounted and covered with a distributor cap mounted on the detector housing.

6 Claims, 3 Drawing Figures

ROTATIONAL POSITION DETECTING DEVICE FOR INTERNAL COMBUSTION ENGINE

BACKGROUND OF THE INVENTION

The present invention relates to a rotational position detecting device for use in internal combustion engines. More particularly, the invention is concerned with a device for detecting rotational position of a rotating shaft of an internal combustion engine so as to produce angular position signal and reference position signal which are used for various controlling purposes such as ignition timing control and fuel injection control.

A device is known in which angular position signal and reference position signal are obtained by detecting the rotational position of a pulley fixed to a cam shaft of an engine. This type of device is disclosed for example, in JOURNAL OF NIPPONDENSO TECHNICAL DISCLOSURE No. 36-160 published July 15, 1984.

In this known device, the angular position signal and the reference position signal are derived from an angular position sensor and a reference position sensor which are so positioned as to face, respectively, angular position information section and a reference position information section formed on the pulley. In order that the clearances between the paths of movements of the information sections and respective sensors may be maintained accurately, both sensors are supported by brackets which in turn are positioned relative to the pulley with bearings disposed therebetween.

In this known rotational position detecting device, however, the sensors are arranged on the side of the pulley adjacent to the engine block. Thus, a substantial space is required between the pulley and the adjacent wall of the engine block to accommodate the sensors. As a result, the pulley has to be spaced apart from the adjacent wall of the engine block by a clearance large enough to provide the above-mentioned space. Thus, a cooperating pulley on the engine crankshaft is required to be also offset by the same amount from the engine block so as to assure that both pulleys are drivingly connected by a belt. Thus, the known device requires substantial change of the engine design with a resultant significant increase in the overall size of the engine.

SUMMARY OF THE INVENTION

Accordingly, an object of the invention is to provide a rotational position detecting device having a compact construction and being capable of ensuring a high precision of the clearances between both sensors and the associated angular and reference position information sections without necessitating any substantial change of the engine design.

It is another object of the invention to provide an engine rotational position detector and distributor assembly.

The rotational position detecting device according to the present invention is adapted to be used with an internal combustion engine of the type that has a cam shaft extending outwardly from the engine through a wall of the engine block and a rotary member fixed to the cam shaft and driven therewith by an engine crankshaft. The device includes reference position information means and angular position information means both fixed to the end face of the driven rotary member remote from the wall of the engine block so that the reference position and angular position information means are both moved along circular paths when the rotary member is rotated. The reference position and angular position information means are disposed at different radial distances from the axis of the driven rotary member. A reference position sensor and an angular position sensor are respectively disposed to face the circular paths of the reference position and angular position information means. A housing is fixed to the engine block to cover the driven rotary member and support the sensors. The housing has an end wall formed therein with an opening coaxial with the cam shaft. The cam shaft has an outer end portion extending outwardly beyond the driven rotary member into and through the opening. A bearing is mounted in the opening to rotatably receive the outer end portion of the cam shaft and position the housing with respect to the cam shaft.

The engine rotational position detecting device having the structure briefly discussed above has an advantage that, because the housing is precisely positioned by the bearing relative to cam shaft and because the sensors are supported by the housing, the sensors can be precisely positioned relative to the paths of circumferential movements of the reference position and angular position information means on the rotary member. The device has an additional advantage that, because the reference position and angular position information means are both disposed on the end face of the rotary member remote from the engine block, the rotary member can be positioned in closely spaced relationship to the adjacent wall of the engine block with a resultant compact engine design.

The engine rotational position detector and distributor assembly provided by the present invention has all of the afore-mentioned elements of the engine rotational position detecting device and, in addition, a distributor rotor mounted on the outer end extremity of the crankshaft extending beyond the bearing. The distributor rotor is covered with a conventional distributor cap mounted on the housing. The engine rotational position detector and distributor assembly has an advantage that, because the distributor cap is fixed to the detector housing which in turn is precisely positioned by the bearing relative to the cam shaft, as pointed out above, the distributor cap can also be precisely positioned relative to the circular path of the rotatable movement of the radially outer end of the distributor rotor.

The above and other objects, features and advantages of the present invention will be made more apparent by the following description of a preferred embodiment of the invention with reference to the accompanying drawings.

DESCRIPTION OF THE PREFERRED EMBODIMENT

Figure 1:
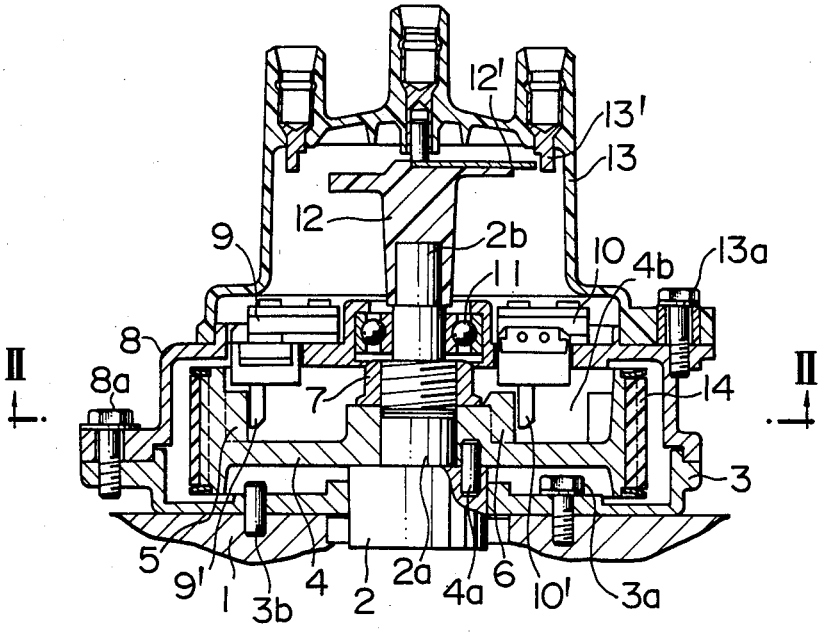
FIG. 1 is an axial sectional view of an embodiment of the rotational position detecting device of the invention.
Figure 2:
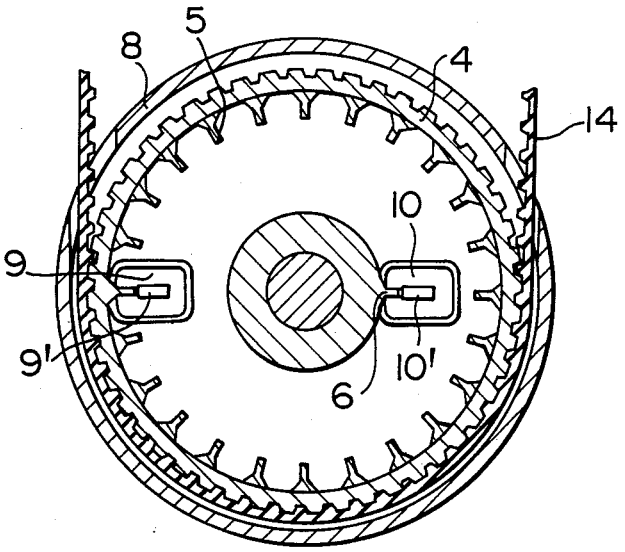
FIG. 2 is a sectional view taken along line II—II in FIG. 1.
Figure 3:
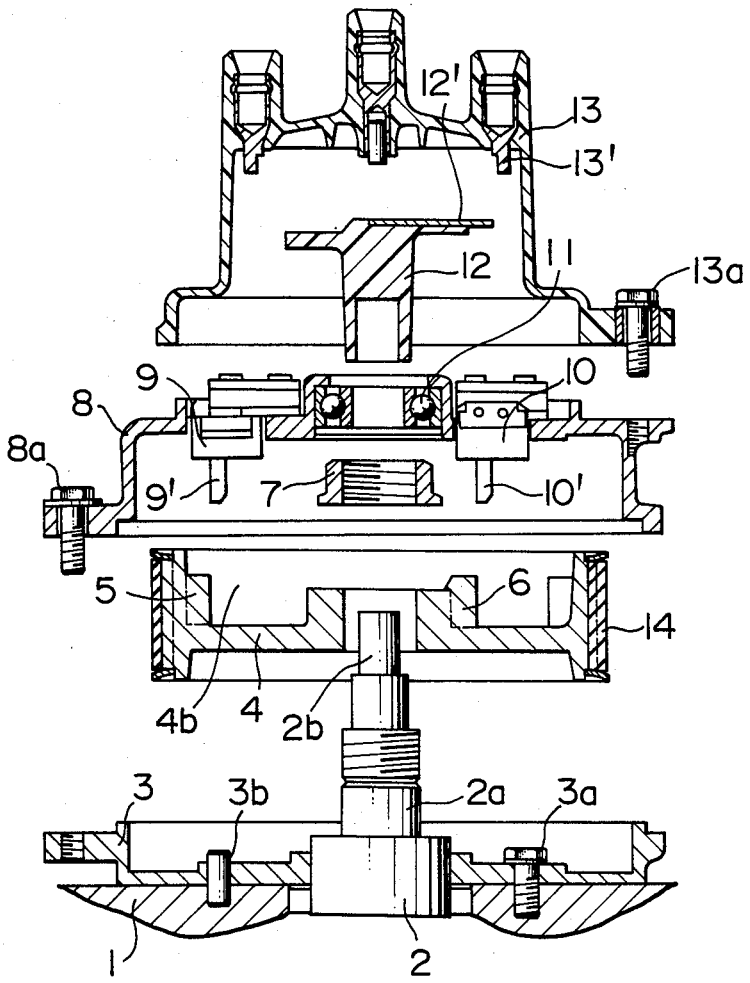
FIG. 3 is an exploded sectional view of the device shown in FIG. 1.

Referring to FIGS. 1 to 3, a plate 3, which forms a constituent part of an ignition distributor, is fixed by means of bolts 3*a* to a wall 1 of an engine block of an internal combustion engine. The plate 3 is correctly located with respect to the wall 1 by a knock pin 3*b*. A cam shaft 2 projects outwardly through the wall 1 and the plate 3. A timing pulley 4 is fixed to a pulley mounting portion 2*a* of the cam shaft 2 by means of a nut 7 and a knock pin 4*a*. A timing belt 14 extends around the pulley 4 so as to transmit the rotation of the engine crankshaft (not shown) through the timing pulley 4 to the cam shaft 2. The side of the timing pulley 4 opposite to the wall 1 of the engine is formed therein with an annular recess 4*b* concentric to the axis of the pulley 4. At least one projection 6 forming a reference position information means is formed on the inner peripheral wall of the annular recess 4*b*, while a plurality of projections 5 constituting the angular position information means are formed on the outer peripheral wall of the annular recess 4. As will be seen in FIG. 1, the projections 5 and 6 are disposed substantially in the same plane.

A housing 8 is fixed by bolts 8*a* to the plate 3 to cover the timing pulley 4. The housing 8 has an end wall with a central hole therein which receives a ball bearing 11 which rotatably supports the outer end of the cam shaft 2.

An electromagnetic reference positicn pickup 10 for generating a crank reference position signal and an electromagnetic crank angular position pickup 9 for generating a crank angular position signal are received in openings formed in the end wall of the housing 8 and project into the annular recess 4*b* in the timing pulley 4. These pickups 9 and 10 are disposed substantially on the same plane as shown in FIG. 1. More specifically, the reference position pickup 10 has a core 10' which is projected into the recess 4*b* so as to oppose the reference position projection 6. Similarly, a core 9' of the angular position pickup 9 projects into the recess 4*b* so s to oppose the angular position projections 5.

A distributor rotor 12 is detachably fitted to the outer end extremity 2*b* of the cam shaft 2 extending beyond the bearing 11. A distributor cap 13 is fixed to the end wall of the housing 8 by means of bolts 13*a* to cover the rotor 12.

The electromagnetic pickups 9 and 10 are both of a known type which is composed of a permanent magnet for generating a magnetic flux and a coil for producing a voltage signal in response to a change in the magnetic flux. Thus, the angular position pickup 9 produces an angular position signal such as a pulse each time when the core 9' thereof is faced by one of the angular position projections 5. Thus, the angular position pickup 9 produces a plurality of angular position pulse signals for each rotation of the timing pulley 4. On the other hand, the reference position pickup 10 produces a reference position signal each time when the core 10' thereof is faced by the reference position projection 6. Thus, the reference position pickup 10 produces one reference position pulse signal for each rotation of the timing pulley 4.

As will be understood from the foregoing description, because the timing pulley 4 carrying the angular position projections 5 and the reference position projection 6 is fixed to the cam shaft 2 and the housing 8 supporting the electromagnetic pickups 9 and 10 is precisely positioned to the same cam shaft 2 through the intermediary of the ball bearing 11, it is possible to minimize errors of the clearances between the cores 9' and 10' of the pickups 9 and 10 and the circular paths of circumferential movements of the projections 5 and 6.

The distributor rotor 12 fixed to the cam shaft 2 and the distributor cap 13 fixed to the housing 9 perform a distribution of high voltage in a manner known per se. For the same reason as above, the clearance between the circular path of distributor terminal 12' of the distributor rotor 12 and distributor electrodes 13' on the distributor cap 13 can also be controlled strictly with respect to the design clearance.

By the described feature of the invention that a plurality of electromagnetic pickups 9 and 10 are arranged substantially on the same plane and the projections 5 and 6 which cooperate with the pickups 9 and 10 are provided on the timing pulley 4 and disposed in a common place but at different radii from the axis of the timing pulley 4, the device can be disposed within a space which is very small as viewed in the axial direction of the cam shaft 2.

The embodiment described hereinbefore employs electromagnetic pickups as the angular position sensor for generating the crank angular position signal and the reference position sensor for generating the crank reference position signal. This, however, is not exclusive and the electromagnetic pickups may be substituted by other types of sensors such as hole sensors. When hole sensors are used, the timing pulley 4 is provided with a suitable member for generating signals in the sensors, e.g., a shielding plate having a plurality of blades.

Although the described embodiment incorporates a conventional distributor composed of the distributor rotor 12 and a distributor cap 13, the rotational position detecting device of the invention need not always be provided with this distributor. Namely, the mechanical distributor composed of the distributor rotor 12 and the distributor cap 13 can be omitted provided that another type of distributor, such as an electronic distributor, is provided for the engine separately from the rotational position detecting device. In such a case, the upper side of the rotational position detecting device ma be covered by a suitable lid which is used in place of the distributor cap 13 in the described embodiment.

It is also possible to arrange such that the housing 8 is directly fixed to the wall 1 of the engine, without the intermediary of the plate 3 used in the described embodiment.

It will be also apparent that a sprocket driven by a chain can be used as the driven rotary member in place of the timing pulley 4 driven by the timing belt 14 used in the described embodiment.

What is claimed is:

1. A device for detecting the rotational position of an internal combustion engine of the type that has a cam shaft extending outwardly from the engine through a wall of the engine block and a rotary member fixed to said cam shaft and driven therewith by a crankshaft of the engine, said device comprising:

reference position information means and angular position information means both fixed to the end face of said driven rotary member remote from said wall of said engine block so that said reference position and angular position information means are both moved along circular paths when said rotary member is rotated, said reference position and angular position information means being disposed at different radial distances from the axis of said driven rotary member;

a reference position sensor and an angular position sensor respectively disposed to face said circular paths of said reference position and angular position information means;

a housing fixed to said engine block to cover said driven rotary member and support said sensors;

said housing having an end wall formed therein with an opening coaxial with said cam shaft;

said cam shaft having an outer end portion extending outwardly beyond said driven rotary member into and through said opening; and a bearing mounted in said opening to rotatably receive said outer end portion of said cam shaft and position said housing with respect to said cam shaft.

2. A rotational position detecting device according to claim 1, wherein said end face of said driven rotary member is formed therein with an annular recess concentric to the axis of said cam shaft, said reference position and angular position information means are both disposed in said annular recess and at least a part of each of said sensors extends into said recess.

3. A rotational position detecting device according to claim 2, wherein said reference position information means comprises at leas one projection formed on one of the radially inner and outer peripheral walls of said annular recess and said angular position information means comprise a plurality of projections formed on the other of said radially inner and outer peripheral walls of said annular recess.

4. A rotational position detector and distributor assembly for an internal combustion engine of the type that has a cam shaft extending outwardly from the engine through a wall of the engine block and a rotary member fixed to said cam shaft and driven therewith by a crankshaft of the engine, said assembly comprising:

reference position information means and angular position information means both fixed to the end face of said driven rotary member remote from said wall of said engine block so that said reference position and angular position information means are both moved along circular paths when said rotary member is rotated, said reference position and angular position information means being disposed at different radial distances from the axis of said driven rotary member;

a reference position sensor and an angular position sensor respectively disposed to face said circular paths of said reference position and angular position information means;

a detector housing fixed to said engine block to cover said driven rotary member and support said sensors;

said detector housing having an end wall formed therein with an opening coaxial with said cam shaft;

said cam shaft having an outer end portion extending outwardly beyond said driven rotary member into and through said opening;

a bearing mounted in said opening to rotatably receive said outer end portion of said cam shaft and position said detector housing with respect to said cam shaft;

said outer end portion of said cam shaft having an end extremity extending outwardly beyond said bearing;

a distributor rotor mounted on said crankshaft end extremity for rotation therewith; and a distributor cap fixed to said distributor housing to cover said distributor rotor.

5. A rotational position detector and distributor assembly according to claim 4, wherein said end face of said driven rotary member is formed therein with an annular recess concentric to the axis of said cam shaft, said reference position and angular position information means are both disposed in said annular recess and at least each of said sensors has a portion extending into said recess.

6. A rotationl position detector and distributor assembly according to claim 5, wherein said reference position information means comprises at least one projection formed on one of the radial inner and outer peripheral alls of said annular recess and said angular position information means comprise a plurality of projections formed on the other of said radially inner and outer peripheral walls of said annular recess.

* * * * *